US009502169B2

(12) United States Patent
Kanbe et al.

(10) Patent No.: US 9,502,169 B2
(45) Date of Patent: Nov. 22, 2016

(54) COMMON MODE CHOKE COIL AND MANUFACTURING METHOD THEREOF

(71) Applicant: MURATA MANUFACTURING CO., LTD., Kyoto (JP)

(72) Inventors: Yuki Kanbe, Nagaokakyo (JP); Shinya Hirai, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 101 days.

(21) Appl. No.: 14/527,490

(22) Filed: Oct. 29, 2014

(65) Prior Publication Data

US 2015/0162126 A1 Jun. 11, 2015

(30) Foreign Application Priority Data

Dec. 10, 2013 (JP) ..... 2013-255293

(51) Int. Cl.

| | |
|---|---|
| ***H01F 27/02*** | (2006.01) |
| ***H01F 27/29*** | (2006.01) |
| ***H01F 5/00*** | (2006.01) |
| ***H01F 27/28*** | (2006.01) |
| ***H01F 17/04*** | (2006.01) |
| ***H01F 17/06*** | (2006.01) |
| ***H01F 19/04*** | (2006.01) |

(52) U.S. Cl.

CPC ..... *H01F 27/2823* (2013.01); *H01F 17/06* (2013.01); *H01F 19/04* (2013.01); *Y10T 29/49071* (2015.01)

(58) Field of Classification Search

CPC ..... H01F 5/00; H01F 27/28; H01F 27/30
USPC ..... 336/200, 232, 83, 192, 221, 222, 220
See application file for complete search history.

(56) References Cited

U.S. PATENT DOCUMENTS

| | | | | |
|---|---|---|---|---|
| 2009/0045902 | A1* | 2/2009 | Hirai | H01F 17/045 336/192 |
| 2014/0097928 | A1* | 4/2014 | Tomonari | H01F 27/28 336/207 |
| 2014/0167903 | A1* | 6/2014 | Tomonari | H01F 17/045 336/220 |

FOREIGN PATENT DOCUMENTS

| | | | |
|---|---|---|---|
| JP | 2006-261564 A | | 9/2006 |
| JP | 2008091359 A | * | 4/2008 |
| JP | 2011-253888 A | | 12/2011 |
| JP | 2014-075533 A | | 4/2014 |
| JP | 2014-120730 A | | 6/2014 |
| JP | 2014-199904 A | | 10/2014 |

OTHER PUBLICATIONS

An Office Action; "Notification of Reasons for Refusal," issued by the Japanese Patent Office on Nov. 4, 2015, which corresponds to Japanese Patent Application No. 2013-255293 and is related to U.S. Appl. No. 14/527,490; with English language translation.

* cited by examiner

*Primary Examiner* — Tsz Chan
(74) *Attorney, Agent, or Firm* — Studebaker & Brackett PC

(57) ABSTRACT

A common mode choke coil has a core including a winding base, and a first and a second wire wound around the winding base side by side. The winding base includes a first area and a second area. The first area is from a first end of a region where the first wire is in contact with the winding base to a first point in the region. The second area is from a second end, which is opposite to the first end, of the region to a second point in the region. The second area does not overlap with the first area. When the first and second wires on a same turn are compared with each other, in the first area, the first wire is located nearer the first end, and in the second area, the first wire is located nearer the second end.

4 Claims, 9 Drawing Sheets

COMMON MODE CHOKE COIL AND MANUFACTURING METHOD THEREOF

CROSS REFERENCE TO RELATED APPLICATIONS

This application claims benefit of priority to Japanese Patent Application No. 2013-255293 filed Dec. 10, 2013, the entire content of which is incorporated herein by reference.

TECHNICAL FIELD

The present disclosure relates to a common mode choke coil and a manufacturing method thereof.

BACKGROUND

As a conventional common mode choke coil, a common mode choke coil disclosed by Japanese Patent Laid-Open Publication No. 2006-261564 is known. In a common mode choke coil of this kind, while a signal is passing through the common mode choke coil, a differential-mode signal may be partly converted into a common-mode signal, and a differential-mode signal may be partly converted into a common-mode signal. (This is hereinafter referred to as mode conversion). In a differential transmission circuit for which such a common mode choke coil is used, the common-mode signal generated by the mode conversion becomes radiation noise, and the differential-mode signal generated by the mode conversion causes a malfunction of the circuit. Thus, such conventional common mode choke coils have a problem that radiation noise is caused or that the immunity of the circuit is lowered.

SUMMARY

An object of the present invention is to provide a common mode choke coil capable of inhibiting radiation noise and improving the immunity of a circuit, and a manufacturing method thereof.

According to a first embodiment of the disclosure, a common mode choke coil comprises: a core including a winding base extending in an axial direction, the winding base including a first area and a second area; a first wire wound around the winding base; and a second wire wound around the winding base side by side with the first wire. The first area is an area from a first end of a region where the first wire is in contact with the winding base to a first point in the region. The second area does not overlap with the first area and is an area from a second end, which is opposite to the first end, of the region where the first wire is in contact with the winding base to a second point in the region. When the first wire and the second wire on a same turn are compared with each other, in the first area, the first wire is located nearer the first end, and in the second area, the first wire is located nearer the second end.

A second embodiment of the disclosure is a method for manufacturing the common mode choke coil above. In the method, both of the first and second wires are wound so as to be in contact with the winding base.

In the common mode choke coil according to the first embodiment, when the first wire and the second wire on a same turn are compared with each other, in the first area, the first wire is located nearer the first end, and in the second area, the first wire is located nearer the second end. With this arrangement, the distribution of an electromagnetic field generated by an alternating current flow in the wires can be inhibited from concentrating on the first side or the second side. Consequently, in the common mode choke coil according to the first embodiment, mode conversion can be inhibited, thereby resulting in inhibition of radiation noise and an improvement in the immunity of the circuit.

DETAILED DESCRIPTION

Structure of Common Mode Choke Coil

Figure 1:
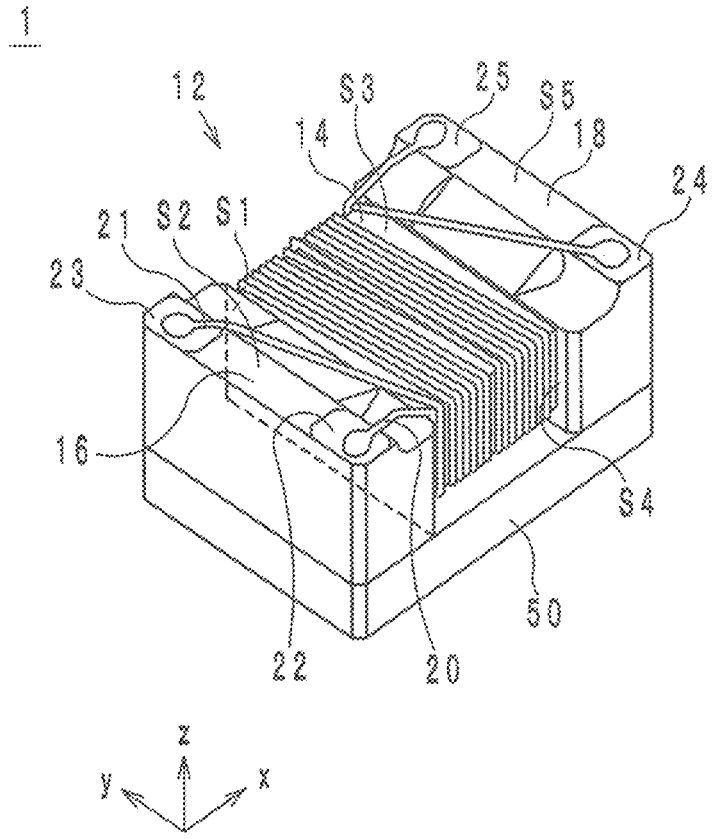
FIG. 1 is a perspective view of a common mode choke coil according to an embodiment of the present disclosure.
Figure 2:
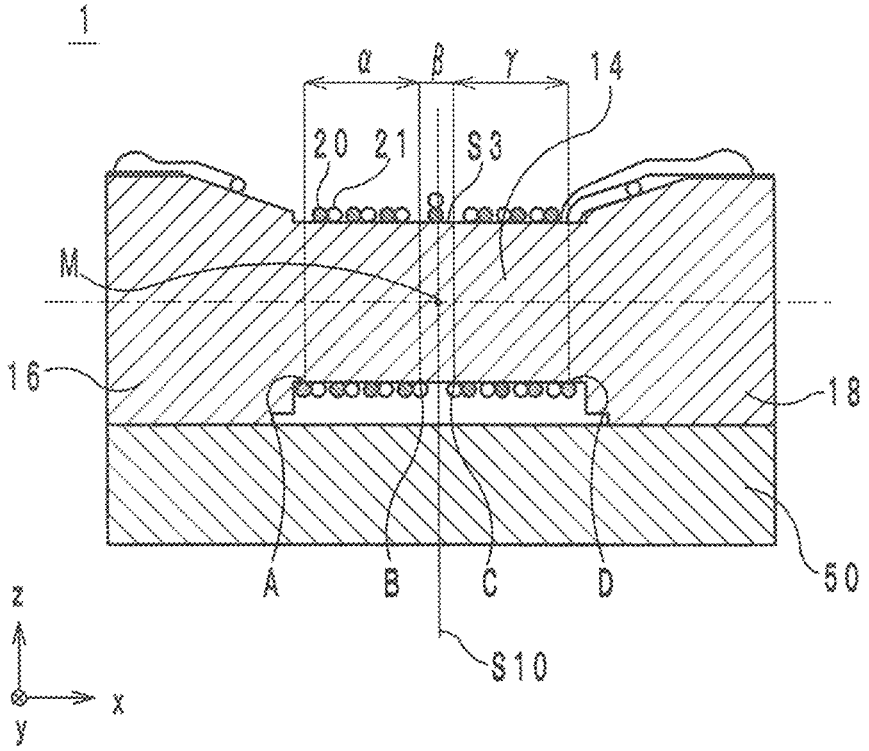
FIG. 2 is a sectional view of the common mode choke coil according to the embodiment when viewed from a direction orthogonal to an axial direction of a winding base.

See FIGS. 1 and 2

A common mode choke coil 1 according to an embodiment of the present disclosure is hereinafter described with reference to the drawings. In the following, the direction of the central axis of a winding base 14 is defined as an x-direction. When viewed from the x-direction, the direction along the longer sides of a flange 16 is defined as a y-direction, and the direction along the shorter sides of the flange 16 is defined as a z-direction. The x-direction, y-direction and z-direction are orthogonal to one another.

As illustrated in FIG. 1, the common mode choke coil 1 comprises a core 12, wires 20 and 21, external electrodes 22 through 25, and a plate-like core 50.

The core 12 is formed of, for example, ferrite, alumina or the like. The core 12 includes a winding base 14, and flanges 16 and 18.

The winding base 14 is in the shape of a rectangular column extending in the x-direction. However, the winding base 14 does not necessarily have to be in the shape of a rectangular column and may be in the shape of a cylinder.

The flanges 16 and 18 are provided at both ends in the x-direction of the winding base 14. Specifically, the flange 16 is provided at a negative end in the x-direction of the winding base 14. The flange 18 is provided at a positive end in the x-direction of the winding base 14.

The flange 16 is in the shape of a substantially rectangular parallelepiped. An edge between a surface S1 of the flange 16 on a positive side in the x-direction and a surface S2 of the flange 16 on the positive side in the z-direction (first side) is chamfered. More specifically, the flange 16 has a bevel between the surface S2 and a surface S3 of the winding base 14 on the positive side in the z-direction, and the bevel is hollowed in the parts on both sides in the y-direction.

The flange 18 is in the shape of a substantially rectangular parallelepiped. An edge between a surface S4 of the flange 18 on the negative side in the x-direction and a surface S5 of the flange 18 on the positive side in the z-direction is chamfered. More specifically, the flange 18 has a bevel between the surface S5 and the surface S3 of the winding base 14, and the bevel is hollowed in the parts on both sides in the y-direction.

The external electrodes 22 through 25 are formed of Ni, an Ni-based alloy (for example, Ni—Cr, Ni—Cu or the like), Ag, Cu, Sn or the like. The external electrodes 22 through 25 are substantially rectangular when viewed from the positive side in the z-direction.

The external electrodes 22 and 23 are provided on the surface S2 of the flange 16 so as to be arranged in this order from a negative side to a positive side in the y-direction. In this regard, the external electrodes 22 and 23 are spaced from each other so as not to contact with each other.

The external electrodes 24 and 25 are provided on the surface S5 of the flange 18 so as to be arranged in this order from the negative side to the positive side in the y-direction. In this regard, the external electrodes 24 and 25 are spaced from each other so as not to contact with each other.

The wires 20 and 21 are conductive wires wound around the winding base 14. Each of the wires 20 and 21 is formed by coating a wire core consisting primarily of a conductive material such as copper, silver or the like with an insulating material such as polyurethane or the like. Each of the wires 20 and 21 makes 10 turns.

The negative end in the x-direction of the wire 20 (first wire) is connected to the external electrode 22 on the surface S2, and the positive end in the x-direction of the wire 20 is connected to the external electrode 24 on the surface S5.

The wire 21 (second wire) is wound around the winding base 14 so as to extend side by side with the wire 20. The negative end in the x-direction of the wire 21 is connected to the external electrode 23 on the surface S2, and the positive end in the x-direction of the wire 21 is connected to the external electrode 25 on the surface S5.

As illustrated in FIG. 2, in a region where the wire 20 is in contact with the winding base 14, an area from the negative end in the x-direction A (first end) to a point B (first point) that is slightly further in the negative x-direction than the center of the winding base 14 with respect to the x-direction is defined as an area α (first area). In the area α, when the wires 20 and 21 on the same turn are compared with each other, the wire 20 is located nearer the negative end in the x-direction (first end) of the region. In the area α, the number of turns of the wires 20 and 21 are counted with the negative end in the x-direction where the side-by-side winds of the wires 20 and 21 around the winding base 14 starts taken as a starting point.

An area from the point B to a point C (second point) that is slightly further in the positive x-direction than the center of the winding base 14 with respect to the x-direction is defined as an area β, and in the area β, the wire 20 crosses the wire 21. In the region where the wire 20 is in contact with the winding base 14, an area from the positive end in the x-direction D (second end) to the point C (second point) that is slightly further in the positive x-direction than the center of the winding base 14 with respect to the x-direction is defined as an area γ (second area). Since the wire 20 crosses the wire 21 in the area β, in the area γ, when the wires 20 and 21 on the same turn are compared with each other, the wire 20 is located nearer the positive end in the x-direction (second end). The wires 20 and 21 cross each other on the surface S3 of the winding base 14. In the area γ, the number of turns of the wires 20 and 21 are counted with the positive end in the x-direction where the side-by-side winds of the wires 20 and 21 around the winding base 14 starts taken as a starting point.

In the sectional view of FIG. 2, the wires 20 and 21 are arranged so as to be symmetric about an orthogonal plane S10 that is orthogonal to the central axis of the winding base 14 and passes a middle point M on the central axis between the area α and the area γ.

The plate-like core 50 is formed of ferrite, alumina or the like, and the plate-like core 50 is in the shape of a substantially rectangular parallelepiped. The plate-like core 50 is fixed on the negative side in the z-direction of the core 12 by an adhesive. By the fixation of the plate-like core 50 to the core 12, a closed magnetic circuit is formed.

Manufacturing Method

Figure 3:
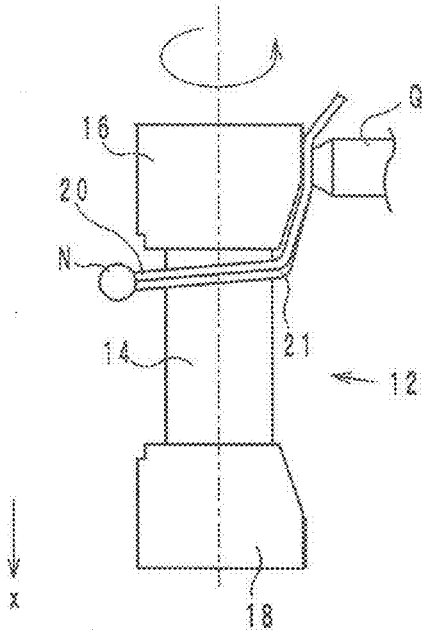
FIG. 3 illustrates a step of a manufacturing process of the common mode choke coil according to the embodiment.
Figure 4:
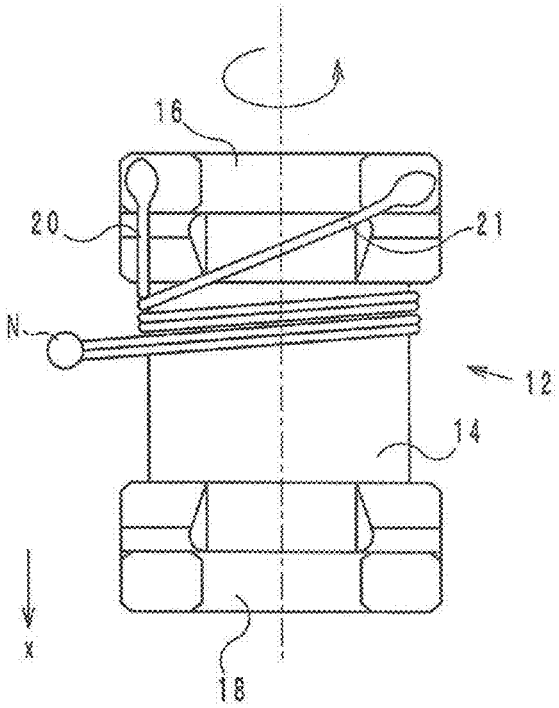
FIG. 4 illustrates a step of the manufacturing process of the common mode choke coil according to the embodiment.
Figure 5:
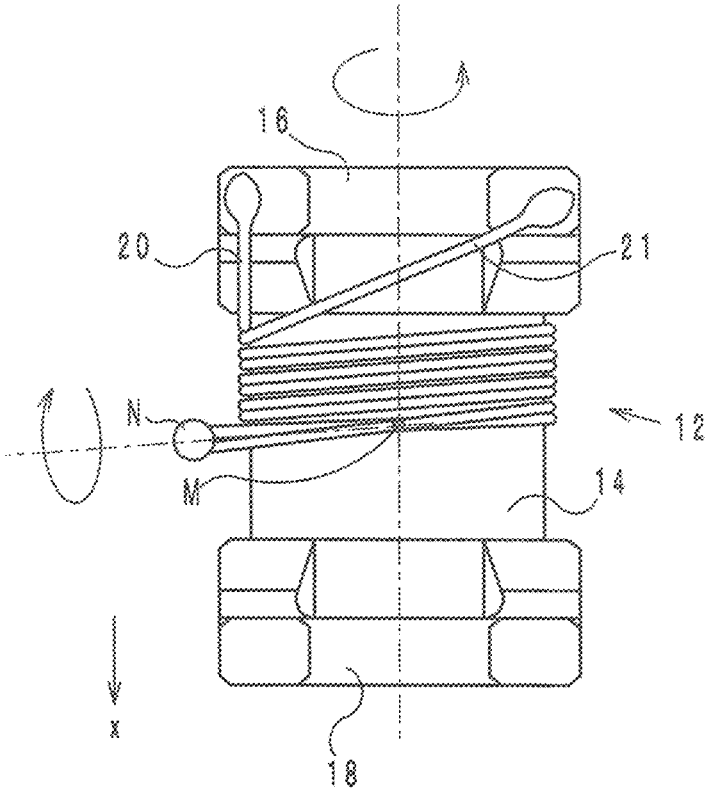
FIG. 5 illustrates a step of the manufacturing process of the common mode choke coil according to the embodiment.

See FIGS. 3-5

Next, a manufacturing method of the common mode choke coil according to the embodiment is described.

First, a powder consisting mainly of ferrite is prepared as a material for the core 12. The ferrite powder is filled in a female die. The filled powder is pressed by a male die. Thereby, the powder is molded into a shape with the winding base 14 and the flanges 16 and 18.

Thereafter, the material molded into the shape with the winding base 14 and the flanges 16 and 18 is sintered, and the core 12 is produced.

In order to form the external electrodes 22 through 25, Ag paste is applied on the positive and negative end portions in the y-direction of the surface S2 of the flange 16 and the surface S5 of the flange 18. The applied Ag paste is dried and baked, and thereby, Ag films, which serve as underlayers of the external electrodes 22 through 25, are formed. Next, Ni films are formed on the Ag films, for example, by electroplating. Further, Sn films are formed on the Ni films, for example, by electroplating. Through the process above, the external electrodes 22 through 25 are formed.

Next, the wires 20 and 21 are wound around the winding base 14 of the core 12. At the step of winding the wires 20 and 21, as illustrated in FIG. 3, the two wires 20 and 21 are pulled out simultaneously from a nozzle N. The pulled-out wires 20 and 21 are put on the external electrodes 22 and 23, respectively, on the flange 16, and are pressed by a heater chip Q against the flange 16. Thereby, the wires 20 and 21 are pressure-bonded to the external electrodes 22 and 23, respectively. The excess portions of the wires 20 and 21 protruding outward from the flange 16 of the core 12 are cut. Next, as illustrated in FIG. 4, while the core 12 is revolved on an axis extending along the winding base 14, the nozzle N is moved gradually from the neighborhood of the flange 16 toward the flange 18. Thereby, both of the wires 20 and 21 are wound around the winding base 14 side by side keeping in contact with the winding base 14. At this stage, the wires 20 and 21 are wound such that the wire 20 is located on the negative side in the x-direction of the wire 21.

As illustrated in FIG. 5, when the nozzle N is coming to the middle point M, the nozzle N is turned by 180 degrees so as to invert the positional relation between the wires 20 and 21. Thereafter, the nozzle N is moved gradually further toward the flange 18 while the core 12 is revolved on the axis extending along the winding base 14. Accordingly, in the area near the flange 18, that is, in the area further in the x-direction than the middle point M, the wire 20 is located on the positive side in the x-direction of the wire 21. Then, the wires 20 and 21 are put on the flange 18 and are pressed by the heater chip Q against the flange 18. Lastly, the excess portions of the wires 20 and 21 protruding outward from the flange 18 of the core 12 are cut. In this way, the common mode choke coil 1 is produced.

Advantageous Effects

See FIGS. 1, 2, 6 and 7

In the common mode choke coil 1, as seen in FIG. 2, when the wires 20 and 21 on the same turn are compared with each other, in the area α, the wire 20 is located on the negative side in the x-direction of the wire 21, and in the area γ, the wire 20 is located on the positive side in the x-direction of the wire 21. With this arrangement, the distribution of an electromagnetic field generated by an alternating current flow in the wires 20 and 21 can be inhibited from concentrating on the negative side in the x-direction or the positive side in the x-direction. Accordingly, in the common mode choke coil 1, mode conversion can be inhibited, thereby resulting in inhibition of radiation noise and an improvement in the immunity of the circuit. In the following, the advantageous effects of the common mode choke coil 1 will be described compared with a common mode choke coil 500 according to a comparative example, which is an example of conventional common mode choke coils. The definitions of x-direction, y-direction and z-direction with respect to the common mode choke coil 500 conform to those with respect to the common mode choke coil 1.

Figure 6:
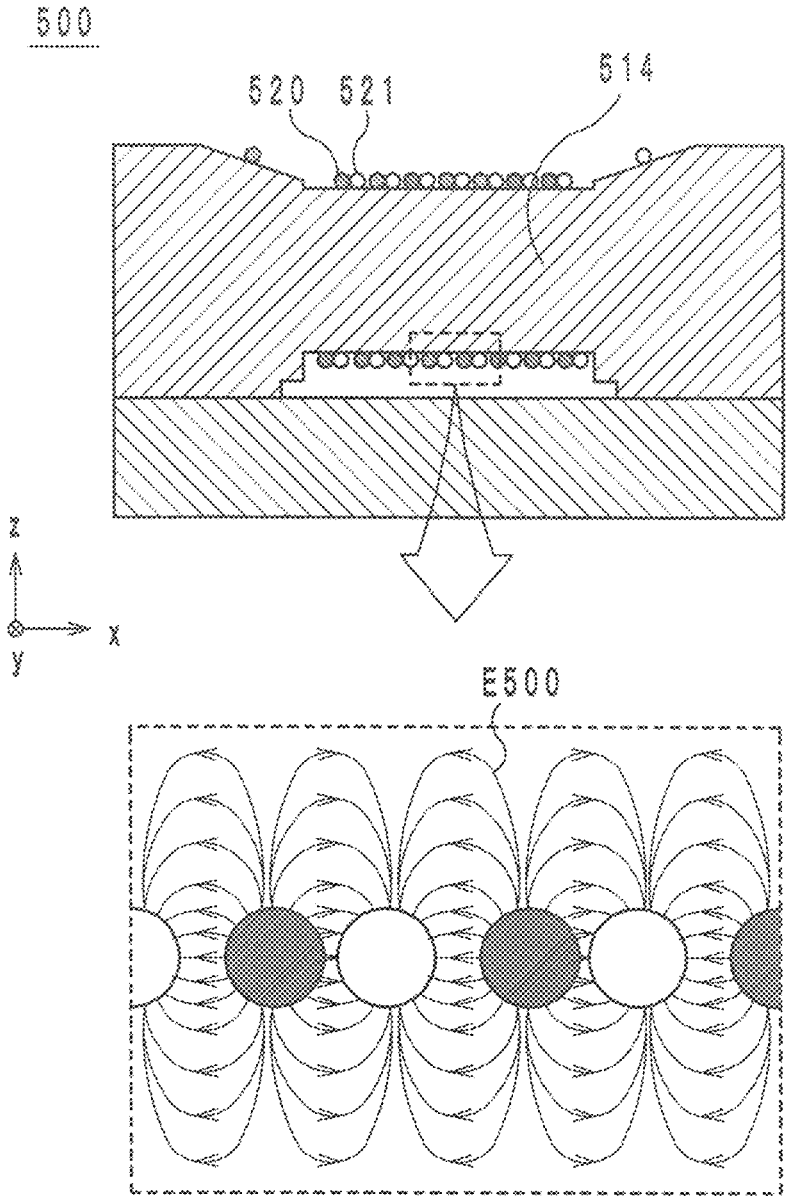
FIG. 6 PRIOR ART
FIG. 6 indicates the direction of electric field around wires when a differential-mode signal is applied to a common mode choke coil according to a comparative example.
Figure 7:
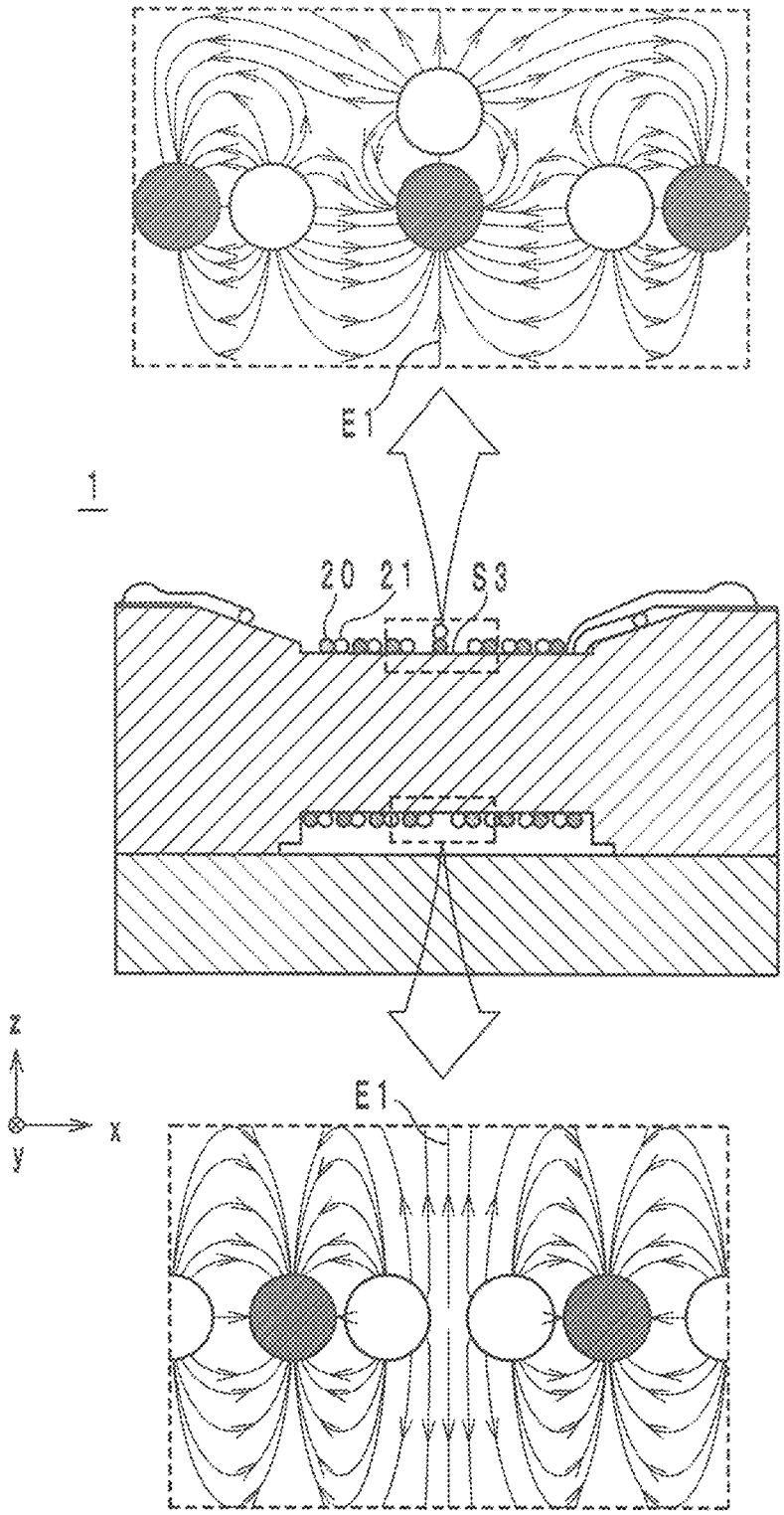
FIG. 7 indicates the direction of electric field around wires when a differential-mode signal is applied to the common mode choke coil according to the embodiment.

As illustrated in FIG. 6, in the common mode choke coil 500, an electric field E500 around the center of a winding base 514 is directed to one side in the extending direction of the winding base 514 (directed to the negative side in the x-direction). Accordingly, in the common mode choke coil 500, the electromagnetic field distribution as a whole concentrates on one side of the winding base 514. In the common mode choke coil 1, however, the wire 20 is located on the negative side in the x-direction of the wire 21 in the area α and is located on the positive side in the x-direction of the wire 21 in the area γ, that is, the arrangement of the wires 20 and 21 is symmetric about the center in the x-direction, and with this arrangement, an electric field E around the center of the winding base 14 is directed in the z-direction. Thus, in the common mode choke coil 1, since the electric field around the center of the winding base 14 is directed to neither the negative side nor the positive side in the x-direction, the electromagnetic field distribution as a whole is symmetric about the center of the winding base 14 with respect to the extending direction, and the electromagnetic field distribution can be inhibited from concentrating on the negative or positive side in the x-direction. Consequently, in the common mode choke coil 1, mode conversion can be inhibited, thereby resulting in inhibition of radiation noise and an improvement in the immunity of the circuit.

In the common mode choke coil 1, as seen in FIG. 1, the wires 20 and 21 cross each other in substantially the center of the surface S3 of the winding base 14. The wires 20 and 21 make the same number of turns, and more specifically, both of the wires 20 and 21 make 10 turns. In such a case where the wires 20 and 21 cross each other in the center of the region where the wires 20 and 21 make an even number of turns, the wires 20 and 21 shall be made to cross each other on the surface of the winding base on the same side as the external electrodes which the wires 20 and 21 are drawn to, that is, on the surface S3 on the positive side in the z-direction, so that the number of turns of the wires 20 and 21 in the area α becomes equal to the number of turns of the wires 20 and 21 in the area γ. With this arrangement, uneven distribution of the electromagnetic field of the common mode choke coil 1 can be inhibited more effectively. When the wires 20 and 21 make an odd number of turns, the wires 20 and 21 shall be made to cross each other in the center of the region where the wires 20 and 21 are wound and on the opposite surface of the winding base 14 from the external electrodes which the wires 20 and 21 are drawn to, that is, on the surface of the winding base 14 on the negative side in the z-direction. With this arrangement, in such a case also, uneven distribution of the electromagnetic field of the common mode choke coil 1 can be inhibited more effectively.

Modification

Figure 8:
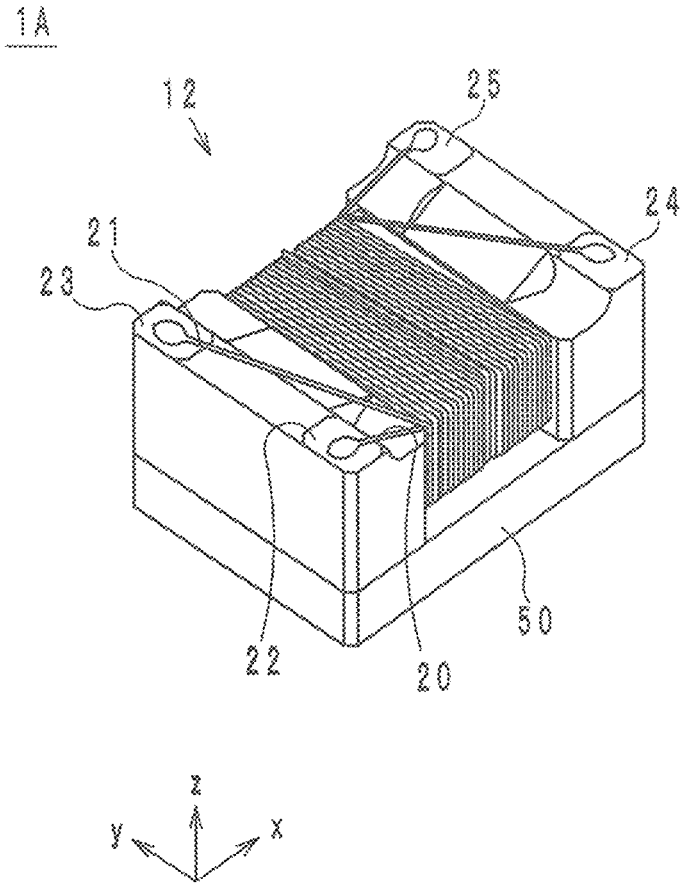
FIG. 8 is a perspective view of a common mode choke coil according to a modification.
Figure 9:
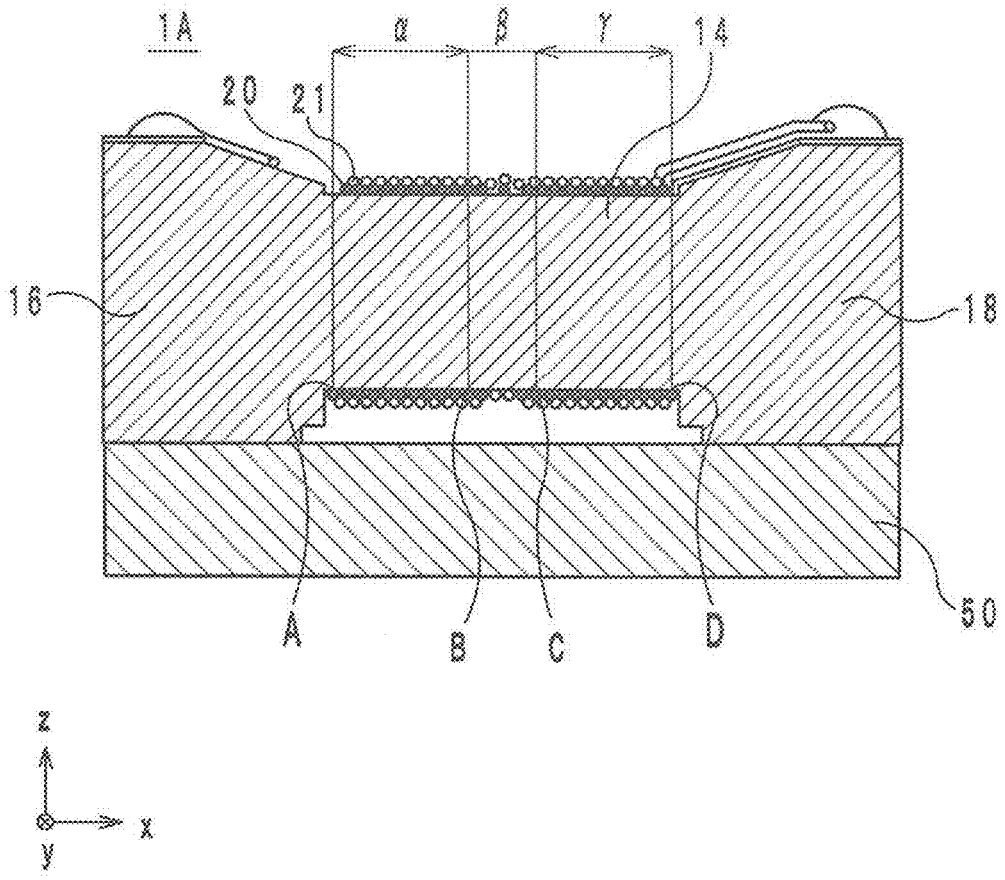
FIG. 9 is a sectional view of the common mode choke coil according to the modification when viewed from a direction orthogonal to an axial direction of a winding base.

As is apparent from FIG. 8, a common mode choke coil 1A according to a modification is different from the common mode choke coil 1 in the number of turns of the wires 20 and 21 and in the way of winding the wires 20 and 21. Specifically, in the common mode choke coil 1A, as illustrated in FIG. 9, the wire 20 is wound on the winding base 14, and further, the wire 21 is wound over the wire 20. Accordingly, in the areas α and γ, the wire 20 is wound sandwiched between the wire 21 and the winding base 14. In the common mode choke coil 1A, since the wires 20 and 21 are wound in this way, the number of turns of the wires 20 and 21 becomes 32, which is larger than that in the common mode choke coil 1.

In the common mode choke coil 1A, as in the common mode choke coil 1, the wires 20 and 21 are wound around the winding base 14 such that, in the area α from the negative end in the x-direction A of the region where the wire 20 is in contact with the winding base 14 to the point B, the wire 20 is located on the negative side in the x-direction of the wire 21 when the wires 20 and 21 on the same turn are compared with each other. In the area γ from the positive end in the x-direction D of the region where the wire 20 is in contact with the winding base 14 to the point C, the wire 20 is located on the positive side in the x-direction of the wire 21 when the wires 20 and 21 on the same turn are compared with each other.

In the common mode choke coil 1A having the structure above, the number of turns of the wires 20 and 21 can be larger than that in the common mode choke coil 1. Accordingly, the common mode choke coil 1A can attain greater inductance than the common mode choke coil 1.

In the common mode choke coil 1A, as in the common mode choke coil 1, when the wires 20 and 21 on the same turn are compared with each other, in the area α, the wire 20 is located on the negative side in the x-direction of the wire 21, and in the area γ, the wire 20 is located on the positive side in the x-direction of the wire 21. With this arrangement, the distribution of an electromagnetic field generated by an alternating current flow in the wires 20 and 21 can be inhibited from concentrating on the negative side in the x-direction or on the positive side in the x-direction. Consequently, in the common mode choke coil 1A, mode conversion can be inhibited, thereby resulting in inhibition of radiation noise and an improvement in the immunity of the circuit. Except for the difference described above, the structure of the common mode choke coil 1A is similar to that of the common mode choke coil 1. Accordingly, except for the number of turns of the wires 20 and 21 and the way of winding the wires 20 and 21, the description of the common mode choke coil 1 is applicable to the common mode choke coil 1A.

The inventors conducted an experiment to confirm the effects of the common mode choke coils 1 and 1A. Specifically, a sample T1 of the common mode choke coil 1, a sample T2 of the common mode choke coil 1A, and a sample T3 of the conventional common mode choke coil 500 were used for the experiment. With respect to each of the samples T1, T2 and T3, the ratio Sds21 of an output differential-mode signal to an input common-mode signal was measured. The dimensions of each of the samples T1, T2 and T3 were 4.5 mm×3.2 mm×2.6 mm, and in each of the samples T1, T2 and T3, the diameters Φ of the wires wound around the core were 40 μm. The number of turns of the wires in each of the samples T1 and T3 were 10, and the number of turns of the wires in the sample T2 was 32.

Figure 10:
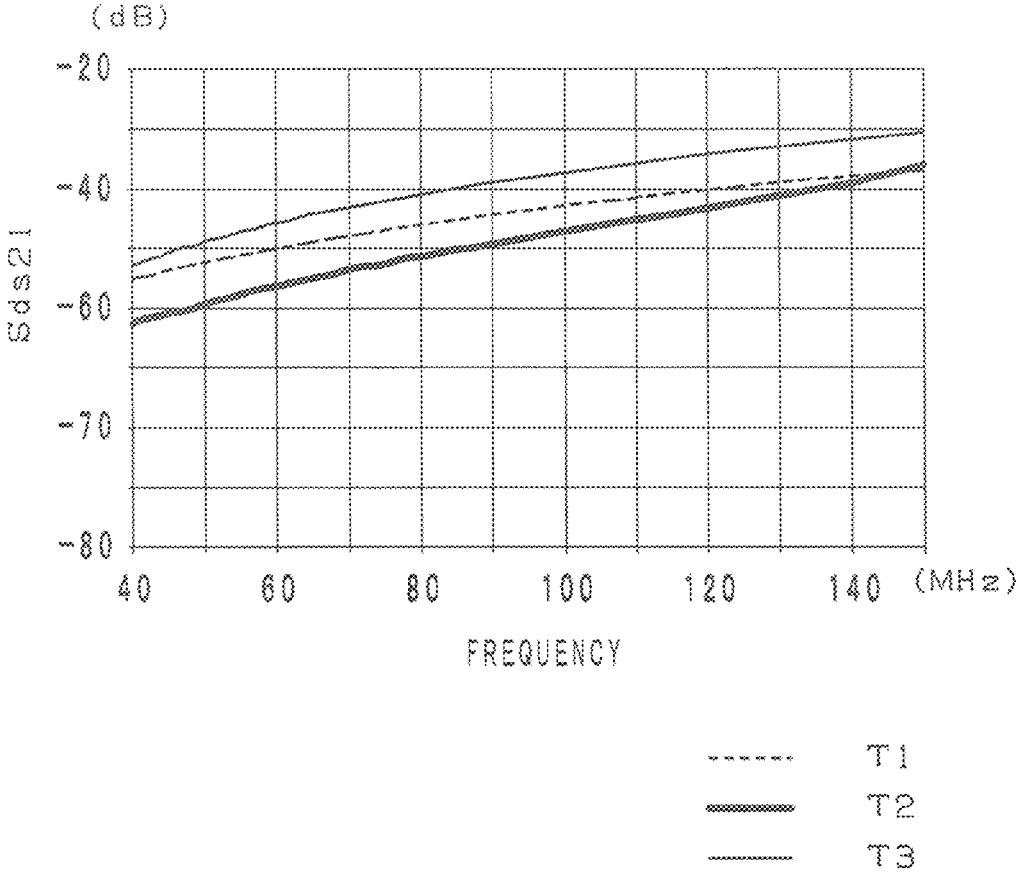
FIG. 10 is a graph showing the relationship between the ratio of an output differential-mode signal to an input common-mode signal and frequency with respect to a sample of the common mode choke coil according to the embodiment, a sample of the common mode choke coil according to the modification and a sample of a common mode choke coil according to the comparative example.

The results of the experiment are illustrated in FIG. 10. As is apparent from FIG. 10, throughout the frequency range subjected to the measurement, the ratio Sds21 of the output differential-mode signal to the input common-mode signal with respect to the sample T1 and that with respect to the sample T2 were lower than that with respect to the sample T3. This means that mode conversion is less likely to occur in the samples T1 and T2 than in the sample T3.

Within the frequency range from 40 MHz to 140 MHz, the ratio Sds21 of the output differential-mode signal to the input common-mode signal with respect to the sample T2 was lower than that with respect to the sample T1. This means that within the frequency range from 40 MHz to 140 MHz, mode conversion is less likely to occur in the sample T2 than in the sample T1. The results of the experiment conducted on the samples T1, T2 and T3 show that mode conversion can be inhibited in the common mode choke coils 1 and 1A.

Other Embodiments

Common mode choke coils and manufacturing methods thereof according to the present disclosure are not limited to the embodiment and modification above, and various changes are possible within the scope of the disclosure. For example, the number of turns of the wires, the shapes and the materials of the winding base and the flanges of the core may be determined arbitrarily. The middle point with respect to the x-direction between the area α and the area γ may not be coincident with the middle point M of the winding base 14. Also, it is possible to combine the structures of the embodiment and modification above.

Although the present disclosure has been described in connection with the preferred embodiment and modification above, it is to be noted that various changes and modifications may be obvious to persons skilled in the art. Such changes and modifications are to be understood as being within the scope of the disclosure.

What is claimed is:

1. A common mode choke coil comprising:

a core including a winding base extending in an axial direction, the winding base including a first area and a second area;

a first wire wound around the winding base; and a second wire wound around the winding base side by side with the first wire;

the first area being an area from a first end of a region where the first wire is in contact with the winding base to a first point in the region;

the second area does not overlap with the first area and is an area from a second end, which is opposite to the first end, of the region where the first wire is in contact with the winding base to a second point in the region; and when the first wire and the second wire on a same turn are compared with each other, in the first area, the first wire is located nearer the first end, and in the second area, the first wire is located nearer the second end, wherein the core further includes flanges provided on both sides of the winding base in the axial direction;

each of the first wire and the second wire is connected to electrodes provided on respective surfaces of the flanges on a first side in an orthogonal direction orthogonal to the axial direction;

the first wire and the second wire make a same number of turns;

the number of turns of the first wire and the second wire is an even number;

the first wire and the second wire cross each other on a surface of the winding base on the first side in the orthogonal direction.

2. The common mode choke coil according to claim 1, wherein the first wire and the second wire are arranged so as to be symmetric about an orthogonal plane orthogonal to the axial direction and passing a middle point with respect to the axial direction between the first area and the second area.

3. The common mode choke coil according to claim 1, wherein in the first area and the second area, the first wire is wound so as to be sandwiched between the second wire and the winding base.

4. A method for manufacturing a common mode choke coil having a core including a winding base extending in an axial direction, the winding base including a first area and a second area;

a first wire wound around the winding base; and a second wire wound around the winding base side by side with the first wire;

the first area being an area from a first end of a region where the first wire is in contact with the winding base to a first point in the region;

the second area does not overlap with the first area and is an area from a second end, which is opposite to the first end, of the region where the first wire is in contact with the winding base to a second point in the region; and when the first wire and the second wire on a same turn are compared with each other, in the first area, the first wire is located nearer the first end, and in the second area, the first wire is located nearer the second end, wherein the core further includes flanges provided on both sides of the winding base in the axial direction;

each of the first wire and the second wire is connected to electrodes provided on respective surfaces of the flanges on a first side in an orthogonal direction orthogonal to the axial direction;

the first wire and the second wire make a same number of turns;

the number of turns of the first wire and the second wire is an even number;

the first wire and the second wire cross each other on a surface of the winding base on the first side in the orthogonal direction, said method comprising the step of winding both of the first and second wires so as to be in contact with the winding base.

* * * * *